United States Patent [19]

Wiedemann

[11] 3,972,717

[45] Aug. 3, 1976

[54] ELECTROPHOTOGRAPHIC RECORDING MATERIAL

[75] Inventor: Wolfgang Wiedemann, Geisenheim-Johannisberg, Germany

[73] Assignee: Hoechst Aktiengesellschaft, Germany

[22] Filed: Mar. 20, 1974

[21] Appl. No.: 453,170

[30] Foreign Application Priority Data

Mar. 21, 1973 Germany ..... 2314051

[52] U.S. Cl. ..... 96/1.5; 96/1.6

[51] Int. Cl.[2] ..... G03G 5/04

[58] Field of Search ..... 96/1.5, 1.4, 1 R, 1.2, 96/1.6

[56] References Cited

UNITED STATES PATENTS

| | | | |
|---|---|---|---|
| 3,287,117 | 11/1966 | Hoegl | 96/1.5 |
| 3,442,781 | 5/1969 | Weinberger | 96/1.5 |
| 3,635,981 | 1/1972 | Weinberger | 96/1 PE |
| 3,667,944 | 6/1972 | Weinberger | 96/1.5 |
| 3,676,313 | 7/1972 | Ciccarelli | 96/1 PE |

*Primary Examiner*—David Klein
*Assistant Examiner*—John L. Goodrow
*Attorney, Agent, or Firm*—James E. Bryan

[57] ABSTRACT

This invention relates to an electrophotographic recording material comprising a conductive support, an organic substance capable of transporting electrical charge, and a dyestuff of purple to violet color, having: (a) an X value in the range of from 0.13 to 0.52 and a Y value within the range of from 0.019 to 0.33 in the CIE system, (b) an extended $\pi$-electron system of at least 20 $\pi$-electrons, and (c) possessing a reflectance of not more than 50% throughout the spectral region of 420 to 750 nm when in the form of a single color-masking layer of about 0.1 g/m$^2$, and which has a high photosensitivity throughout the said spectral range. The invention also relates to a process for the preparation of the novel recording material.

39 Claims, 9 Drawing Figures

Figure 1:
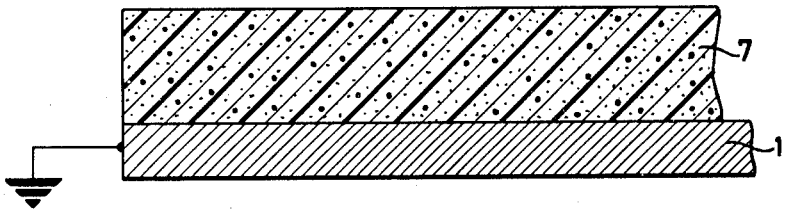

1/E½
cm²/µWsec
0,7
0,5
0,3
0,1
1
2
398
453
505
552
606
650
707
756
λ(nm)

1/E1/2
cm2/μWsec
0,7
0,5
0,3
0,1
1
2
400
500
600
700
λ(nm)

100
(%)
50
10
400
500
600
700
λ(nm)
1
2

100
(%)
80
50
10
2
1
400
500
600
700
λ(nm)

ELECTROPHOTOGRAPHIC RECORDING MATERIAL

This invention relates to electrophotographic recording material comprising a conductive support, optionally an intermediate insulating layer, and a photoconductive system having at least one layer comprising an organic material which transports charges and an organic dyestuff which produces charge carriers, mixed with the conventional additives.

Photoconductive systems of this type are described for example in German Offenlegungsschriften Nos. 2,108,935, 2,108,938, 2,108,939, 2,108,944, 2,108,958, 2,108,963, 2,108,968, 2,108,984, and 2,108,992, and in the older German Offenlegungsschrift 2,220,408.6. These specifications list various dyestuffs which may be used to impart maximum photosensitivity to the systems in the different spectral regions. However, these systems generally have the disadvantage that the photosensitivity deteriorates substantially either in the blue spectral region (420 – 500 nm) or in the red spectral region (from 620 nm onwards).

It is also known that selenium layers are very sensitive in the blue-green spectral region but are practically insensitive in the red spectral region. It already has been proposed to extend the photosensitivity of selenium layers into the red spectral region by adding tellurium (German Pat. No. 991,767), but it is difficult to manufacture such mixed phases reproducibly.

Photoconductor layers of donor-acceptor complexes such as polyvinyl carbazole and 2,4,7-trinitrofluoren-9-one are described in German Auslegeschrift No. 1,572,347; while these are effective over a rather broad spectral region, their photosensitivity is not adequate for all practical needs.

There is accordingly a need for an electrophotographic recording material which possesses panchromatic sensitivity, i.e. a high photosensitivity over the whole of the visible spectral region, i.e. from about 420 to 750 nm.

The present invention provides electrophotographic recording material which includes a conductive support, an organic substance capable of transporting electrical charge, and a dyestuff of magenta to violet color, having an extended $\pi$-electron system, which dye-stuff is photosensitive in the spectral region of 420 to 750 nm, and possesses a reflectance of 50% or less over the aforementioned spectral region when in the form of a single color-masking layer of about 0.1 g/m$^2$.

Optionally, the electrophotographic recording material of the invention may include an insulating intermediate layer between the conductive support and the photoconductive system comprising the charge-transporting substance and the organic dyestuff.

Preferably, the organic dyestuff has a $\pi$-electron system having at least 20 $\pi$-electrons.

The organic dyestuffs used in the photoconductive system of the recording material of the invention have a very high photosensitivity in the visible region of the spectrum; these dyestuffs are distinguished in possessing a relatively constant, high photosensitivity over the entire visible spectral region from about 420 to 750 nm.

The dyestuffs of magenta to violet color are, according to DIN 5033, in a color position range which extends from magenta-red through red-violet and violet to blue-violet. Taking into account color shade and fullness, the values for X lie in the range from about 0.13 to 0.52 and for Y in the range of about 0.019 to 0.33 in the CIE system (Commission Internationale de l'Eclairage). According to the color position system according to DIN 6164, the dyestuffs which are suitable for use in the invention have color shades (T) in the range from 10 to 16, preferably 12 to 16.

Figure 3:
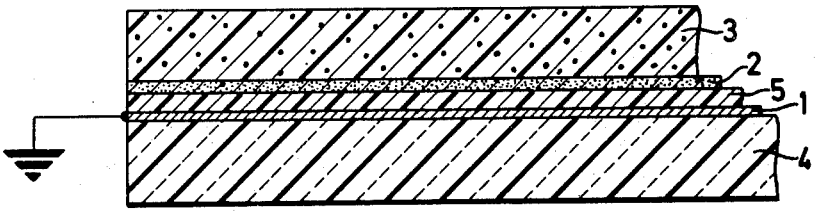
Figure 4:
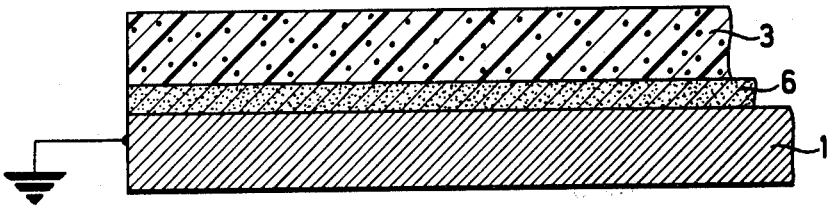
Figure 5:
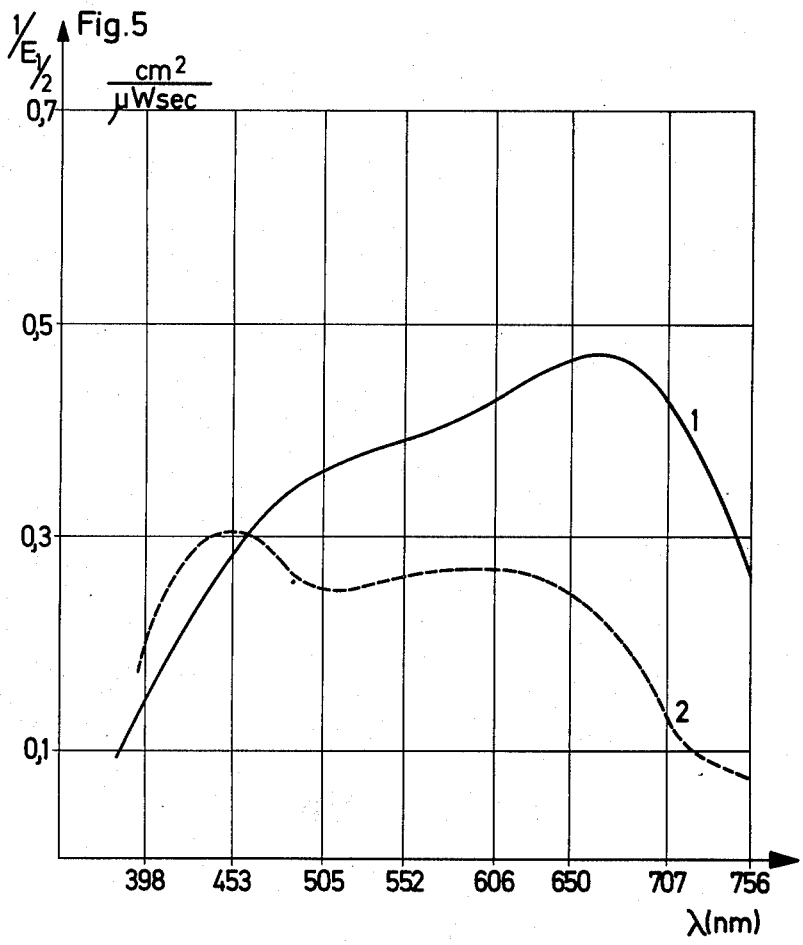
Figure 6:
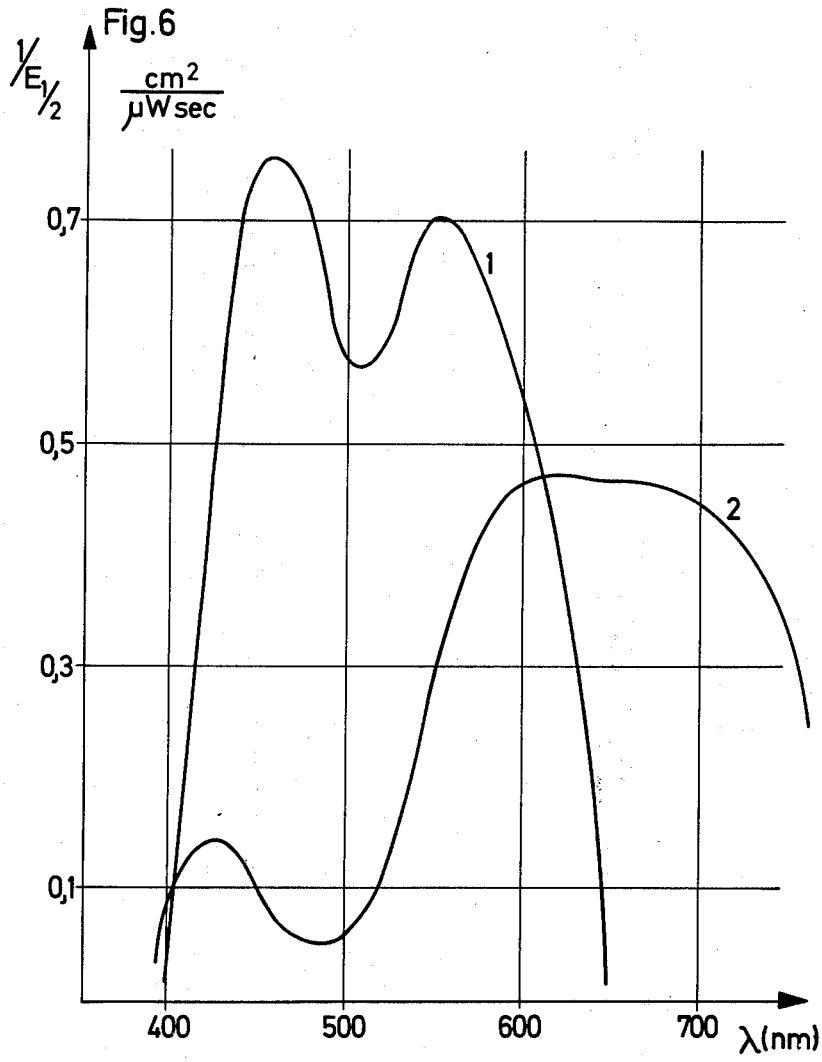
Figure 7:
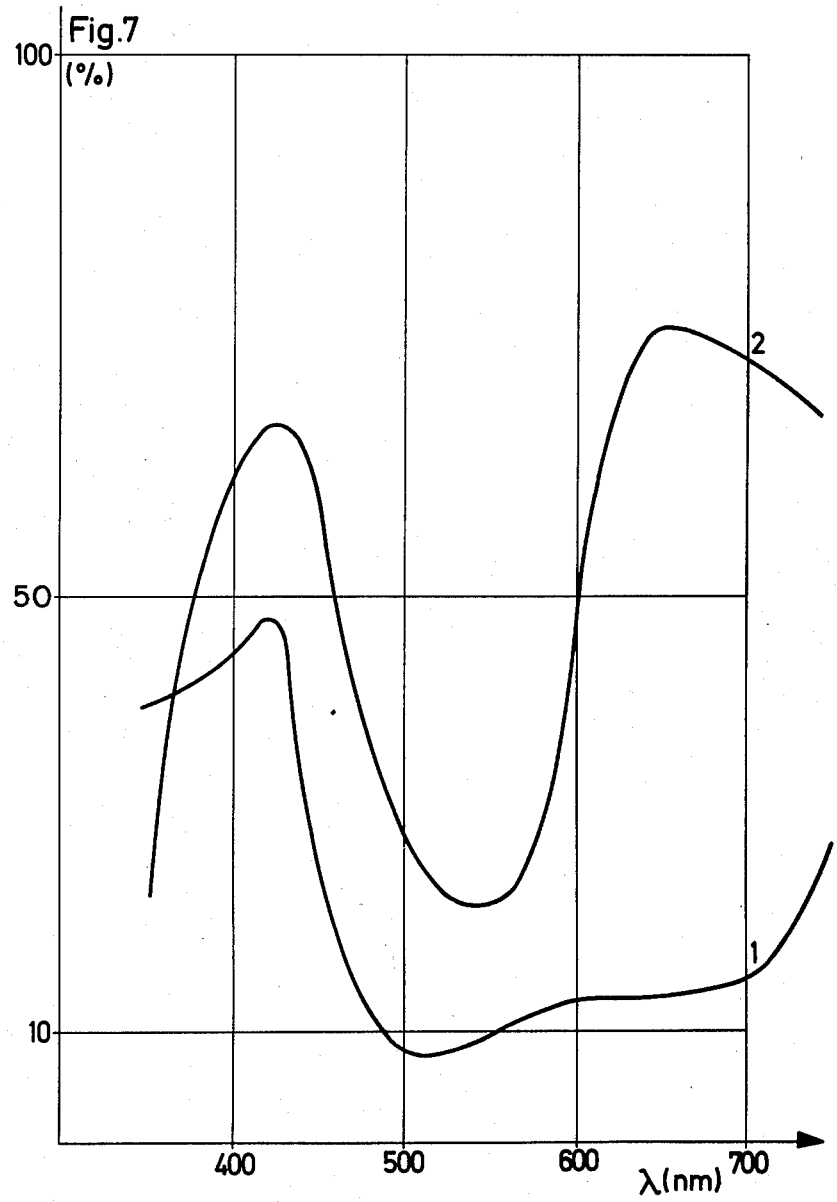
Figure 8:
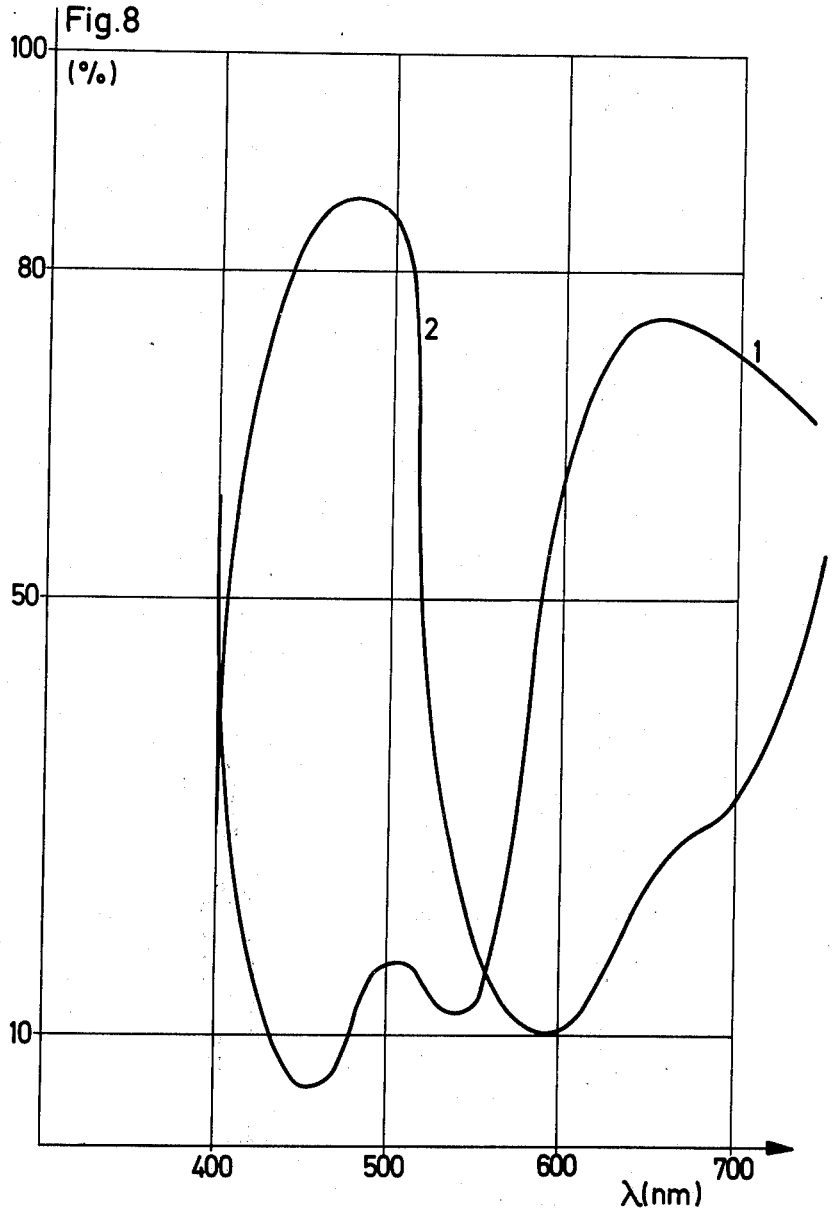
Figure 9:
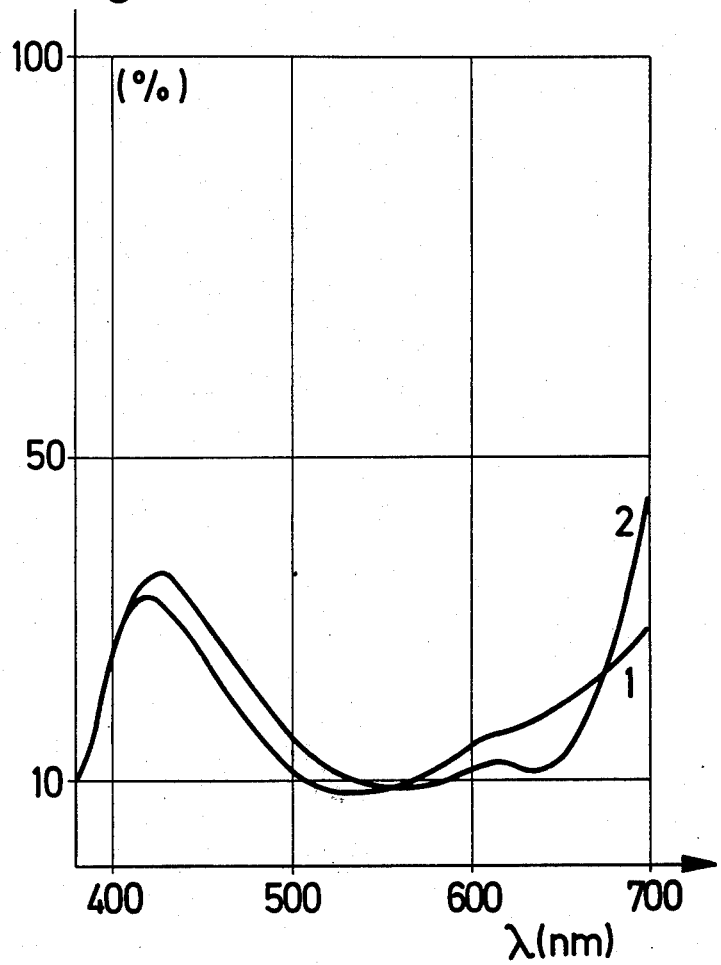

In the following, reference will be made to the accompanying drawings, wherein:

FIGS. 1 to 4 are schematic representations of embodiments of the recording material of the invention, FIG. 5 shows the photosensitivity curve of a dyestuff for use in the invention, FIG. 6 shows the photosensitivity curves of two dyestuffs not for use in the invention, for comparison purposes; and FIGS. 7, 8, and 9 are the reflectance curves of various dyestuff layers.

Figure 2:
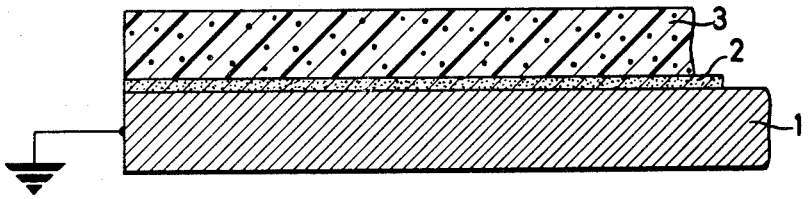

The photoconducting system of the material of the invention may be in a dispersed form, i.e., the dyestuffs which produce charge carriers are dispersed in the charge-transporting substance together with further conventional additives, as illustrated in FIG. 1 of the accompanying drawings. However, a double layer arrangement of the materials for producing the charge carriers and for transporting the charge carriers is preferred, as shown in FIG. 2 (dyestuff layer 2, covering layer 3).

The conductive support material 1 employed is preferably aluminum foil, but also may be transparent polyester film vapor-coated with aluminum 1,4 or polyester film laminated to aluminum 1,4, although any carrier material which has been made sufficiently conducting may be used.

The interpolation of an organic intermediate layer 5, as shown in FIG. 3, and optionally also of a thermally, anodically or chemically produced aluminum oxide intermediate layer, has the function of lowering the charge carrier injection from the conductive support into the photoconductor layer in the dark, while it should not hinder the charge flux during the exposure process. The intermediate layer serves as a barrier layer. A further function of the intermediate layer is to improve the adhesion between the conductive support and the dyestuff layer. Various natural resin and synthetic resin binders may be used for intermediate layers, but materials which adhere well to an aluminum or other metal surface and undergo little surface dissolution upon subsequent application of the covering layer, for example, polyamide resins or polyvinyl phosphonic acid, are preferred.

The thickness of such organic intermediate layers may be up to 5 $\mu$m while the thickness of the aluminum oxide layer is preferably in the range of $10^2 - 10^4$A.

The most important part of the photoconducting system is the organic dyestuff layer which essentially determines the spectral photosensitivity through the absorption behavior or reflectance behavior of the dyestuff used.

The dyestuffs employed according to the invention, which have a magenta to violet color, possess a broad and low reflectivity and have as a result proved particularly suitable for panchromatically sensitive electrophotographic recording material.

The application of a homogeneous, densely packed dyestuff layer is preferentially achieved by vacuum vapor deposition of the dyestuff on the carrier material.

Depending on the vacuum chosen, the dyestuffs can be vapor-deposited without decomposition under relatively favorable conditions ($10^{-3}$ – $10^{-5}$ mm Hg, 250°–400° C heating temperature), with the temperature of the carrier material preferably below 50° C.

Dyestuffs of high heat stability are required to produce the dyestuff layer by vapor deposition in vacuo. The vapor-deposition then produces layers with densely coherent dyestuff molecules. This has the following advantages over all other possible ways of producing a thin dyestuff layer:

1. An optimum rate of generation of charge carriers in the dyestuff layer is achieved, the high extinction coefficients of the dyestuffs permitting a high concentration of excited dyestuff molecules.

2. The charge transport through the densely packed dyestuff layer cannot be hindered by binder.

The charge transport through the dyestuff layer is further favored by the fact that the vapor-deposited dyestuff can be very thin, which gives optimum sensitivity in a double layer arrangement.

An advantageous thickness range of the vapor-deposited dyestuff is between 0.005 and 2 microns, but a range between 0.005 and 0.5 micron is particularly preferred, since here the adhesion and homogeneity of the vapor-deposited dyestuff are particularly advantageous.

A uniform dyestuff thickness also can be achieved by other coating techniques. These include application by mechanically rubbing the very finely powdered dyestuff material into the electrically conducting carrier material; by chemical deposition, for example, of a leuco-base which is to be oxidized; by electrolytic or electrochemical processes; or by the spray gun technique.

Homogeneous dyestuff layers which mask well and are about 1 $\mu$m thick also can be produced by grinding the pigments with a binder and subsequently coating the dyestuff dispersion onto conducting carrier material, as is shown in FIG. 4, in which 6 represents the dyestuff dispersion.

The following known dyestuffs are outstandingly suitable for use in the invention:

The pigment dyestuff of the formula I,

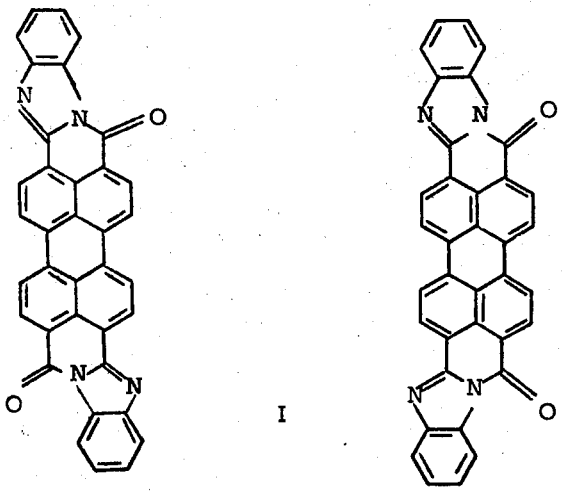

I which may be produced by condensation of perylene-3,4,9,10-tetracarboxylic acid anhydride and o-phenylene-diamine, in accordance with the procedure in Bull. Chem. Soc. Japan 25, 411–413/1952;

the dyestuff of the formula II

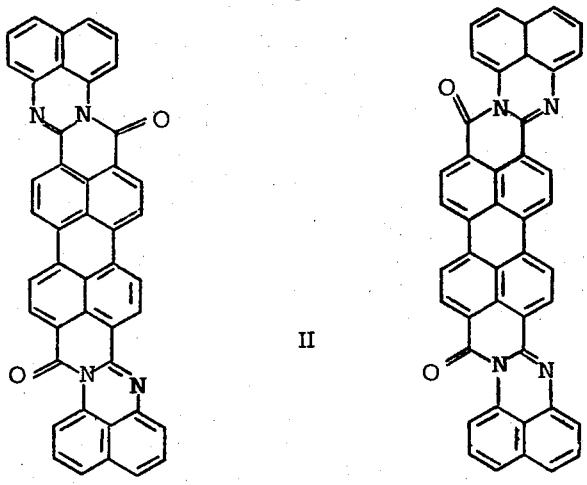

II which may be obtained by condensation of perylene-3,4,9,10-tetracarboxylic acid with 1,8-diaminonaphthalene (Helv. Chim. Acta Vol. 48, 1999 (1965)).

The condensation products of formulae I and II are dyestuffs of blue to magenta or dark violet color, which are probably in the form of cis/trans isomer mixtures. The photosensitivity or spectral region of these condensation products can be influenced by introducing substituents such as halogen, lower alkyl, nitro, nitrile, alkoxy, amino or dialkylamino groups into the components o-phenylenediamine or 1,8-diaminonaphthalene. Reactants such as 2,3-diaminopyridine and 2,3-diaminopyrazine also may be used as preferred condensation partners in order to produce a hypsochromic shift in the spectral photosensitivity. By varying the condensation components, compounds with different color shades can be prepared and as a result the spectral photosensitivity also can be influenced to a certain degree.

When manufacturing the condensation products I or II, a thorough subsequent purification has proved to have an advantageous effect on the sensitivity of the double layers according to the invention. For this purpose, the condensation product which has been filtered off while hot may be twice digested in hot toluene and boiled up at least twice in 5 – 10% by weight NaOH solution to remove unreacted perylene-3,4,9,10-tetracarboxylic acid. The material is then washed with hot water until free of salt and is after-treated with methanol.

In addition to the dyestuffs described, the following dioxazine dyestuffs, also have proved advantageous:

the dyestuff of the formula III:

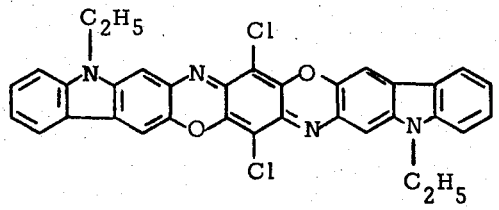

III which is known as Carbazole-dioxazine Violet (C.I. 51,319) and is manufactured by Farbwerke Hoechst AG, Frankfurt, Germany under the trade name "Hostaperm Violet RL";

the dyestuff of the formula IV:

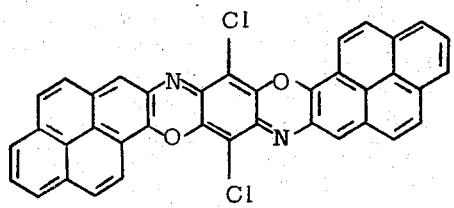

IV

[8,19-dichloro-phenaleno (1,9-ab) pyreno-(1′,2′,:5′,-6′)-(1,4) oxazino (3,2-*i*)-phenoxazine], which is manufactured by Farbwerke Hoechst AG, Frankfurt, Germany, under the trade name "Pyroxazin";

the dyestuff known as "Irgazin Violet 6 RLT" (Ciba-Geigy AG, Basle, Switzerland; reddish-tinged) and "Irgazin Violet BLT" (Ciba-Geigy AG, Basle, Switzerland; bluish-tinged), which are dioxazine derivatives according to Official Digest 37, 486, 782–802 (July 1965).

The dioxazine dyestuffs can be easily prepared and purified. In addition they possess good heat stability and photochemical stability so that they can be vapor-deposited in vacuo without decomposition and also do not undergo any photochemical changes under xerographic conditions.

As has already been mentioned, the active spectral region of the dyestuffs to be used in the invention extends over practically the entire visible wavelength region (420 – 750 nm). This is demonstrated by the spectral photosensitivity curve 1 (FIG. 5) for the dyestuff according to the formula I and also by the reflectance curve of the corresponding dyestuff layer (FIG. 7, curve 1). The reflectance curves of the "Irgazin" dyestuffs mentioned are shown as curves 1 and 2 of FIG. 9.

In addition to the dyestuffs suitable for use in the invention, there also exist dyestuffs which can be blue-red-violet-tinged, for example, indigo derivatives. The reflectance curve of a violet dye-stuff layer of 4,4′,7,7′-tetrachlorothioindigo is shown by way of comparison in FIG. 7, curve 2. It may be seen that the reflectance is below 50% only in the region of approximately 450 – 600 nm, and hence differs from the reflectance of the dyestuffs according to the invention.

By way of comparison, attention is also drawn to one red dyestuff and one blue dyestuff, which are disclosed in the older German Offenlegungsschriften Nos. 2,237,539.9 and 2,239,924.2, as suitable dyestuffs for production of charge carriers. By way of example, the photosensitivity curve of an electrophotographic recording material with a double layer which contains N,N′-dimethylperylimide as the dyestuff in the dyestuff layer is shown in FIG. 6, curve 1: while the photoconductor layer has a high sensitivity in the blue, green and yellow region, it is for practical purposes virtually insensitive in the red spectral region, beginning from about 620 nm. A comparison with the reflectance behavior is shown in FIG. 8, curve 1, where a drastic rise in the reflectance occurs in the wavelength region around 600 nm. The curve 2 of FIG. 6 is the photosensitivity curve of a blue dyestuff, a metal-free phthalocyanine which, when used as the dyestuff layer in electrophotographic recording material, while possessing good sensitivity in the red-yellow spectral region, becomes progressively more insensitive in the direction of the green and blue region, i.e., below 500 nm. The behavior of the dyestuff layer in reflectance is analogous, as is shown clearly by curve 2 in FIG. 8.

The reflectance measurements were carried out under the following conditions:

To produce the dyestuff layers, vapor deposition was effected in a partial vacuum of $10^{-4} - 10^{-5}$ mm Hg and in a temperature range of approximately 250°–380°C. The dyestuff layer weights used for the optical measurements were all in the range of 80–100 mg/m², and the dyestuff layers were opaque. The carrier material employed was a polyester film vapor-coated with aluminum (weight of aluminum approximately 200 mg/m²); the reflectance of such an aluminum-polyester layer is about 85–80% in the region from 350–750 nm.

The reflectance measurements on the dyestuff layers and on the aluminum-polyester layer were carried out in a Zeiss spectrophotometer DMR 21 with a ZRZ 1 reflectance attachment (integration sphere).

The mechanism of action of the photoconducting double layers can be visualized in accordance with the following scheme:

$$F + h\nu \rightarrow F^* \qquad 1.$$

$$F^* + F \rightarrow F.^+ + F.^- \qquad 2.$$

After excitation (1) of the dyestuff, a charge separation (2) into dyestuff radical ions occurs in the dyestuff layer. At the interface between the dyestuff layer and the organic transparent covering layer, reactions of the excited dyestuff molecules, or of the dyestuff radical-ions formed, with the molecules of the charge transport compound become possible in accordance with the equations shown. Depending upon whether a p-conducting or n-conducting charge transport compound is employed, the sensitivity will be higher in one case for a (−) charge and in the other for a (+) charge.

a. (−) charge, p-transport compound (p-conductor), n-conduction in the dyestuff layer;

$$F.^+ + pL \rightleftharpoons F + pL.^+$$

$$pL.^+ + pL \rightleftharpoons pL + pL.^+$$

$$F.^- + F \rightleftharpoons F + F.^-$$

b. (+) charge, n-transport compound (n-conductor), p-conduction in the dyestuff layer;

$$F.^- + nL \rightleftharpoons F + nL.^-$$

$$nL.^- + nL \rightleftharpoons nL + nL.^-$$

$$F.^+ + P \rightleftharpoons F + F.^+$$

The preferred arrangement according to the invention, in double layers, makes it possible for the charge carriers, after having been homogeneously excited in the densely packed dyestuff layer, to be transported onwards through the relatively thin dyestuff layer with little expenditure of energy. There is the further advantage over photoconductor layers which are sensitized throughout that after injection of the charge carriers (electrons or defect electrons) at the interface, an oriented homogeneous transport of one type of charge carrier through the corresponding covering layer takes place.

Suitable materials for the charge transport are above all organic compounds which possess an extended $\pi$-electron system. These include both monomeric and polymeric aromatic and heterocyclic compounds. Monomers used are especially those which possess at least one dialkylamino group or two alkoxy groups. Heterocyclic compounds such as oxdiazole derivatives, for example those in German Pat. No. 1,058,835, have proved particularly suitable. These in particular include 2,5-bis-(p-diethylaminophenyl)-oxdiazole-1,3,4. Further suitable monomeric electron donor compounds are, for example, triphenylamine derivatives, more highly condensed aromatic compounds such as anthracene, benzo-condensed heterocyclic compounds, pyrazoline derivatives or imidazole derivatives, and also triazole and oxazole derivatives, such as those disclosed in German Pat. Nos. 1,060,260 and 1,120,875.

Examples of polymeric compounds suitable for use as charge transporters are vinyl-aromatic polymers such as polyvinyl anthracene, polyacenaphthylene and vinyl-aromatic copolymers. Poly-N-vinylcarbazole and copolymers of N-vinylcarbazole having a N-vinylcarbazole content of at least about 40% by weight have proved particularly suitable. Formaldehyde condensation products with various aromatics, for example, condensates of formaldehyde and 3-bromopyrene, are also suitable.

In addition to these compounds mentioned, which predominantly possess p-conducting character, n-conducting compounds also may be employed. These so-called electron acceptors are described for example, in German Pat. No. 1,127,218. In particular, compounds such as 2,4,7-trinitrofluorenone or 3,6-dinitro-N-t-butyl-naphthalimide have proved suitable.

If the photoconducting system is present in a dispersed form, the material which serves for charge transport is added to the dyestuff according to the invention (FIG. 1).

However — and this is preferred — the photoconducting system also can be built up of a covering layer 3 and a dyestuff layer 2 in the double layer arrangement according to FIG. 2. Here, the covering layer has a high electrical resistance and prevents the dissipation of the electrostatic charge in the dark. Upon exposure to light, it transports the charges produced in the organic dyestuff layer.

The covering layer 3 is preferably transparent. However, it may not be necessary for the covering layer to be transparent, for example, in the case where the conductive support is transparent.

The covering layer serves as a charge carrier transport layer and, without the dyestuff layer, has a substantially lower photosensitivity in the visible region (420 – 750 nm). The transparent covering layer preferably is composed of a mixture of an electron donor compound and a resin binder if a negative charge is to be produced; if a positive charge is to be produced, the transparent covering layer preferably is composed of a mixture of an electron acceptor compound and a resin binder.

Accordingly, compounds employed for charge transport in the transparent covering layer are those known as electron donors or electron acceptors. They are preferably used in combination with the usual additives, for example, resin binders or adhesion promoters which are matched to the charge transporting compound as regards the charge transport, the properties of the film, adhesion promotion and surface properties. Further conventional additives preferably present are conventional sensitizers or materials which form charge transfer complexes with the charge transporting compound. Finally, further conventional additives such as leveling agents, plasticizers and adhesion promoters also may be present.

Both natural resins and synthetic resins are suitable for use as resin binders with regard to flexibility, film properties and adhesion. Such resins in particular include polyester resins, for example those marketed under the name Dynapol (Trademark) (Dynamit Nobel), or Vitel (Trademark) PE 200 (Goodyear) and which are copolyesters of isophthalic acid and terephthalic acid with glycol. Silicone resins, such as those known under the name "Silicone Resin SR" of General Electric Co., USA, or "DOW 804" of Dow Corning Corp., USA, which are three-dimensionally cross-linked phenylmethyl-siloxanes, and the so-called reactive resins, for example those known under the name "DD lacquers" and composed of an equivalent mixture of "Desmophen" (Trademark) and "Desmodur" (Trademark) grades (Farbenfabriken Bayer AG, Leverkusen, Germany) also have proved suitable. In addition, copolymers of styrene and maleic anhydride, for example, those known under the name "Lytron" (Trademark), (Monsanto Co., U.S.) as well as polycarbonate resins, for example, those known under the name "Lexan" (Trademark) grade of (General Electric Co., U.S.) are readily usable.

The ratio in which the charge-transporting compound and the resin binder are mixed can vary. However, relatively specific limits are imposed by the requirement for maximum photosensitivity, i.e., for as high a proportion as possible of charge-transporting compound and for the avoidance of crystallization, i.e. as high a proportion as possible of resin binders. A mixing ratio of about 3 : 1 to 1 : 4 parts by weight is preferred, with the ratio of 1 : 1 especially preferred.

The presence of one or more additional sensitizers can have an advantageous effect on the charge transport; in addition, they can produce charge carriers in the transparent covering layer. As sensitizers it is possible to employ, for example, Rhodamine B extra, Schultz, Farbstofftabellen (Dyestuff Tables), volume 1, 7th Edition, 1931, No. 864, page 365; Brilliant Green, No. 760, page 315; Crystal Violet, No. 785, page 329; and Cryptocyanin, No. 927, page 397.

Added compounds which form charge transfer complexes with the charge-transporting compound also can act in the same sense as the sensitizers. This makes it possible to achieve a further increase in the photosensitivity of the double layers described. The amount of the added sensitizer or of the compound which forms the charge transfer complex is so chosen that, in the event of transparency being required, the donor-acceptor complex formed, with its charge transfer band, is still sufficiently transparent for the organic dyestuff layer beneath. The optimum concentration range is at a molar donor/acceptor ratio of about 10 : 1 to about 1,000 : 1 and vica versa. Preferentially employed activators are nitrated fluorenone-9 derivatives, nitrated 9-dicyanomethylenefluorene derivatives, nitrated naphthalenes and nitrated naphthalic acid anhydrides or imide derivatives.

In addition to the transparency of the covering layer, the thickness of the layer is also an important parameter with regard to the optimum photosensitivity: Layer thicknesses between about 5 and about 40 microns are preferred. However, it has been found that the thickness ranges vary depending upon whether monomeric or polymeric charge-transporting compounds are employed in the binder. Thus, the ranges for monomeric compounds tend to be thicker (8 to 40 microns) while if polymeric charge-transporting compounds are employed thicknesses in the range of about 5 to 20 microns suffice. Quite generally, a lower maximum charge level must be expected with layer thicknesses below about 5 microns.

The addition of adhesion promoters or plasticizers which may be necessary, especially the addition to polymeric charge-transporting compounds, barely reduces the photosensitivity if suitable materials are employed. For this purpose, for example, chlorinated paraffins and chlorinated diphenyl resins, for example "Clophen W" (Trademark) (Farbenfabriken Bayer AG, Germany) have proved particularly suitable.

As already explained, other arrangements can be used in addition to the preferred double-layer arrangement in which the most important functions of a photoconductor layer, namely producing the charge carriers and transport of the charge carriers, are separated. In particular, these other arrangements include the dispersion of dyestuff particles as homogeneous charge carrier production centers distributed over the layer in a transport medium which is preferably capable of either p-conduction or n-conduction (FIG. 1).

Compared to a double layer, this arrangement has the advantages of being simpler to manufacture, also, less heat-stable dye-stuff may be used. Admittedly, it is a disadvantage that the dyestuff particles are excited only in the upper part of the photoconductor layer and hence do not occupy as optimal an arrangement as in the double layer arrangement.

It has been possible to achieve a high photosensitivity even in the dispersion arrangement; however, the photosensitivity of the double layer is not equalled. In addition, it has been possible to observe that in the case of the dyestuff dispersion arrangement, the dark discharge can easily increase.

The covering layers of the type used in the material of the invention possess the property of permitting a high charge coupled with a low dark discharge. While with all conventional sensitizations an increase in the photosensitivity is coupled with an increase in the dark current, this parallelity can be avoided here. As a result, these layers can be used both in electrophotographic copying apparatuses of low copying speed and very low lamp energy and apparatuses of high copying speed and correspondingly higher lamp output. Because of their panchromatic sensitivity range, the photoconducting systems of the invention are particularly suitable for use in color copying apparatuses.

The following Examples further illustrate the invention.

EXAMPLES

In a vacuum vapor deposition apparatus of Messrs. Bendiz/Friedberg, the pigment dyestuff of formula 1 was vapor-deposited for 1 to 3 minutes under a partial vacuum of $8 \times 10^{-5}$ to $10^{-4}$ mm Hg and a heating temperature of 350° – 370°C, and the pigment dyestuff Hostaperm Violet RL (Formula III) was vapor-deposited for approximately 5 minutes under a partial vacuum of $8 \times 10^{-5}$ mm Hg and a heating temperature of 290 – 320°C.

For this purpose the carrier materials namely aluminum foil, polyester film vapor-coated with aluminum or polyester film laminated with aluminum, were mounted at a distance of approximately 15 cm from the dyestuff vaporizer source.

The vapor-deposited dyestuff layers were homogeneous and glossy and masked the carrier material completely. The color of the vapor-deposited layers was blue-violet. The weights of the dyestuff layer, determined gravimetrically, were primarily in the range of from 0.01 to 0.5 g/square meter, i.e. assuming a dyestuff density of 1.5 g/cc, these weights correspond to a thickness range of about 0.006 – 0.35 $\mu$m.

The dyestuff layers listed in the subsequent Examples were produced according to this method.

Color measurement of the dyestuff layers at a layer thickness in the range of 0.08 to 0.1 g/m², carried out according to DIN 5033 (standardized light of type C) with a color measuring apparatus of Messrs. Carl Zeiss (Elrepho), gave the following results:

Dyestuff according to the formula I X = 0.25 Y = 0.17

Dyestuff according to the formula III X = 0.16 Y = 0.13

EXAMPLE 1

A solution of equal parts by weight of 2,5-bis-(p-diethylaminophenyl)-oxidazole-1,3,4 and a polyvinyl chloride/polyvinyl acetate copolymer, for example, Hostaflex M 131 (Trademark) Farbwerke Hoechst AG) in tetrahydrofuran was coated at a thickness of approximately 12 to 23 microns (after drying) onto a dyestuff layer of the pigment dyestuff according to the formula I. The thickness of the dyestuff layer was about 0.12 g/square meter.

A homogeneous, glossy, photoconducting double layer was obtained, the sensitivity of which was determined in accordance with the following method:

The photoconductor layer was conveyed on a rotating plate through a charging device (corona setting 6.0 kV, grid 1.1 kV) to an exposure station, where it was exposed to an Osram XBO 150 xenon lamp. A KG 3 heat absorption glass of Messrs. Schott + Gen., Mainz, Germany and a neutral filter of 15% transparency were placed in front of the lamp, so that the light intensity in the plane of measurement was approximately 375 $\mu$ W/cm². The charge level ($U_o$) and the photoinduced light decay curve were recorded oscillographically through a transparent probe via a 610 CR electrometer (Keithley Instruments, U.S.A.). The photoconductor layer was characterized by the charge level ($U_o$) and the time ($T_{1/2}$) after which half the charge ($U_o/2$) had been reached.

The determination of the charge level ($U_o$) and of the half-life ($T_{1/2}$) gave the following values for the double layers and for a correspondingly prepared covering layer on the carrier material (blank layer):

| | $-U(V)$ | $T_{1/2}$ (msec) | $\Delta U_D$ |
|---|---|---|---|
| Blank layer | 925 | approx. 650 | — |
| Double layer (with dyestuff I), thickness ~ 12$\mu$m | 825 | 16.5 | 210 |
| Double layer (with dyestuff I), thickness ~ 23 $\mu$m | 1,175 | 22 | 110 |

In addition, the table shows the values, $\Delta U_D$, for the dark decay of these layers, after 2 seconds, measured in a Dyntest 90 apparatus (Messrs. ECE, Giessen, Germany).

To determine the spectral photosensitivity of the double layer (covering layer 12$\mu$m), the following procedure was employed: using a negative charge, the half-life ($T_{1/2}$ msec) was determined, for each particular wavelength region, by exposure to an XBO 150 xenon lamp in front of which were placed monochromatic filters (line filters, half-width 10–12 nm, Schott + Gen., Mainz). The spectral photosensitivity of the double layer was determined by plotting the reciprocal value of the product of the half-life, in seconds, and the light intensity I in $\mu W/cm^2$, against the wavelength $\lambda$in nm. The reciprocal value of $T_{1/2}$. I denotes the light energy which must be received by a unit area in order to discharge the layer to half the initial potential $U_o$. The curve is shown in the attached FIG. 5 (curve 1).

By way of comparison, the spectral photosensitivity of an approximately 12 $\mu$m thick photoconductor layer of polyvinyl carbazole and 2,5,7-trinitrofluorenone-9, in the molar ratio of 1 :1, determined under the same conditions, is shown in FIG. 5 (curve 2).

EXAMPLE 2

As a modification of the photoconductor in the covering layer, a solution of 1 part by weight of 2-phenyl-4(2-chlorophenyl)-5(4-diethylaminophenyl)-oxazole and one part by weight of polyester resin, for example Dynapol L 206 (Trademark) (Dynamit Nobel AG, Germany) was whirler-coated at a thickness of approximately 9$\mu$m onto a dyestuff layer of the compound according to the formula I.

The sensitivity, determined as in Example 1, was found to be: (−) charge (U): 470 V. Half-life $T_{1/2}$ = 60 msec.

EXAMPLE 3

A solution of equal parts by weight of 2,4,7-trinitrofluorenone-9 and polyester resin [(Dynapol L 206 (Trademark) (Dynamit Nobel AG, Germany)] in tetrahydrofuran, was applied at a thickness of approximately 10$\mu$m onto a dyestuff layer of the compound of the formula I.

Homogeneus glossy double layers were obtained, the sensitivity of which, when positively charged, was very high. The conditions of measurement were the same as those described under Example 1.

| | U(V) | $T_{1/2}$ (msec) |
|---|---|---|
| Blank layer | +750 | 1,000 |
| Double layer | +460 | 55 |

EXAMPLE 4

Hostaperm violet RL (a dioxane derivative according to the formula III, from Farbwerke Hoechst AG) was vapor-deposited in accordance with the initial description, onto an aluminum carrier material provided with an approximately 0.2$\mu$m thick organic intermediate layer composed of a polyamide resin (Elvamide 8061 (Trademark, Du Pont, USA).

A solution of equal parts by weight of 2,5-bis(4-diethylaminophenyl)-oxdiazole-1,3,4 and polyester resin (Dynapol L 206) was applied at a thickness of approximately 7–8$\mu$m onto such a homogeneous dyestuff layer.

Measurement of the sensitivity according to Example 1, but with a light intensity of 1 = 499$\mu W/cm^2$, gave a negative charge ($U_o$) of 470 V and a half-life T = 46 msec.

EXAMPLE 5

The pigment dyestuff Pyroxazin (a dioxazine derivative, formula IV) (Farbwerke Hoechst AG) was vapor-deposited in a partial vacuum of approximately 5 × $10^{-4}$ mm Hg and using a heating temperature of 350°C onto an aluminum foil (approximately 100 $\mu$m) for 2.5 minutes.

The dark violet dyestuff layer was then coated with a solution of equal parts by weight of 2,5-bis-(4-diethylaminophenyl)oxdiazole-1,3,4 and polyester resin (Dynapol L 206) in a thickness of approximately 9–10$\mu$m.

The photosensitivity was measured as described in Example 1:

(−) Charge 1,000 V. $T_{1/2}$ (−) = 155 msec.

EXAMPLE 6

An approximately 5% by weight solution of polyvinyl carbazole (Luvican M 170 (Trademark) BASF) in tetrahydrofuran was applied at different whirler speeds onto a dyestuff layer of the dyestuff according to the formula I which had been vapor-deposited on a polyester film laminated to aluminum. Layer thicknesses of approximately 5 or 10$\mu$m could be obtained thereby. After drying for 20 hours at approximately 100°C, the photosensitivity of the double layer was determined in accordance with Example 1:

| | Thickness ($\mu$m) | −U(V) | $T_{1/2}$ (msec) |
|---|---|---|---|
| Blank layer | approx. 8 | 975 | 1 sec |
| Double layer | approx. 5 | 725 | 8.5 |
| Double layer | approx. 10 | 1,000 | 15.5 |

EXAMPLE 7

3-bromopyrene resin was prepared by condensation of 3-bromopyrene, melting point 94°–95° (Organic Synthesis, Volume 48 (1968), page 30), with formaldehyde in glacial acetic acid.

An approximately 30% by weight 3-bromopyrene resin solution in tetrahydrofuran was whirler-coated onto a dyestuff layer of pigment dyestuff according to the formula I. The thickness of the coating was approximately 10$\mu$m after drying for 1 hour at 80°C.

The photosensitivity was measured according to Example 1 and was as follows:

| | −U(V) | $T_{1/2}$ (msec) |
|---|---|---|
| Blank layer 8 $\mu$m | 900 | 445 |
| Double layer | 725 | 24 |

The dark decay was measured in a Dyestuff-90 apparatus. With a charge of −1,050 V, a dark decay of $\Delta U_D$ = 75 V was measured after 2 seconds.

EXAMPLE 8

A substantial increase in the photosensitivity of the double layer described in Example 7 was achieved by adding activators to the 3-bromopyrene resin covering layer. A double layer was produced in the manner described in Example 7 but a small amount (molar ratio 1 : 0.001) of 9,10-dicyano-methylene-2,7-dinitrofluorene was first added to the 3-bromo-pyrene resin solution and the solution was then whirler-coated onto the dyestuff layer. A blank layer (without dyestuff) was produced in the same way. The layer thicknesses were approximately 10$\mu$m.

The photosensitivity, determined as described in Example 1, was found to be:

| | (−) Charge (V) | $T_{1/2}$ (msec) |
|---|---|---|
| Blank layer | 950 | 125 |
| Double layer | 950 | 13.5 |

The dark decay (Dyntest-90) of these layers was very low; for the double layer, $\Delta U_D = 40$ V was measured after 2 seconds.

EXAMPLE 9

Various binders can be employed when using monomeric charge carrier transport materials, for example, oxdiazole derivatives mentioned.

For this purpose, a dyestuff layer of pigment dyestuff according to the formula I was coated with solutions of equal parts by weight of photoconductor and resin binder.

The results of the photosensitivity measurement were determined as described in Example 1; they are summarized in the table which follows:

| Photoconductor/binder (1:1) | | (−)charge V | $T_{1/2}$(msec) | Thickness ($\mu$m) |
|---|---|---|---|---|
| Silicone Resin SR 182 | | 725 | 18 | 10 |
| Copolymer of styrene and maleic anhydride | | 875 | 65 | 10 |
| Desmophen 1,100 / Desmodur HL | DD lacquer | 540 | 35 | 7 |

EXAMPLE 10

A dyestuff layer containing a pigment dyestuff of the formula II was obtained by vapor deposition in a partial vacuum of approximately $3 \times 10^{-4}$ mm Hg for 3 minutes at a heating temperature of 450°C.

After applying an approximately 10 $\mu$m thick covering layer of 2,5-bis-(4-diethylaminophenyl)-oxdiazole-1,3,4 and polyester resin (Dynapol L 206) in a weight ratio of 1 : 1, a half-life of $T_{1/2} = 175$ msec was measured at a charge of −675 V.

EXAMPLE 11

The pigment dyestuff according to the formula I was suspended in an amount of 1% by weight, relative to solids content, in an approximately 28% by weight solution of equal parts by weight of 2,5-bis-(4-diethylaminophenyl)-oxdiazole-1,3,4 and polyester resin (Dynapol L 206) in tetrahydrofuran. The dispersing operation was carried out in a PM 1 Perl mill (Draiswerke, Mannheim, Germany) for 60 minutes. The dispersion was then whirler-coated onto an approximately 18 $\mu$m thick aluminum foil and dried for 30 minutes at 110°C.

The photosensitivity of this dispersion layer was measured as in Example 1:

(− Charge 1,000 V. $T_{1/2}$ (−) = 155 msec

EXAMPLE 12

The Irgazin (Trademark) pigments Irgazin Violet 6 RLt (reddish-tinged violet) and Irgazin Violet BLT (bluish-tinged violet) were vapor-deposited for approximately 3 minutes onto aluminum foil in a partial vacuum of approximately $7 \times 10^{-5}$ mm Hg and at a heating temperature of 215°–250°C and 300°–330°C respectively. According to the statements of the manufacturer, (Ciba-Geigy AG), in IRGAZINGEIGY No. 1453., the materials are dioxazine derivatives of the following basic structure:

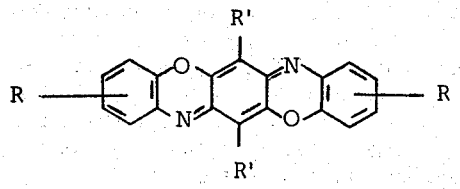

A solution of equal parts by weight of 2,5-bis-(4-diethylaminophenyl)-oxdiazole-1,3,4 and polyester resin (Dynapol L 206) was then whirler-coated at a thickness of approximately 10 $\mu$m onto these dyestuff layers. The measurement of the photosensitivity according to Example 1, but at a light intensity $I = 615\ \mu W/cm^{-2}$ gave the following values:

| | (−) charge (V) | $T_{1/2}$(msec) |
|---|---|---|
| Double layer with | | |
| Irgazin Violet 6 RLt | 750 | 61 |
| Irgazin Violet BLT | 850 | 103 |

It will be obvious to those skilled in the art that many modifications may be made within the scope of the present invention without departing from the spirit thereof, and the invention includes all such modifications.

What is claimed is:

1. Electrophotographic recording material comprising a conductive support, an organic photoconductive substance capable of transporting electrical charge selected from the group consisting of p- and n-conducting compounds, and a dyestuff of purple to violet color, having:

a. an X value in the range of from 0.13 to 0.52 and a Y value within the range of from 0.019 to 0.33 in the CIE system, b. an extended $\pi$-electron system of at least 20 $\pi$-electrons, and c. possessing a reflectance of not more than 50% throughout the spectral region of 420 to 750 nm when in the form of a single color-masking layer of about 0.1 g/m$^2$, and which has a high photosensitivity throughout the said spectral range.

2. A material as claimed in claim 1 wherein the dyestuff has a color shade (T), according to DIN 6164, of from 10 to 16.

3. A material as claimed in claim 2 wherein the dyestuff has a color shade (T) of from 12 to 16.

4. A material as claimed in claim 1 wherein the dyestuff is a condensation product of perylene-3,4,9,10-tetracarboxylic acid and an aromatic diamine.

5. A material as claimed in claim 4 wherein the dyestuff is a condensation product of perylene-3,4,9,10-tetracarboxylic acid and o-phenylenediamine or a substitution product thereof.

6. A material as claimed in claim 4 wherein the dyestuff is a condensation product of perylene-3,4,9,10-tetracarboxylic acid and 1,8-diaminonaphthalene or a substitution product thereof.

7. A material as claimed in claim 4 wherein the dyestuff is a condensation product of perylene-3,4,9,10-tetracarboxylic acid and 2,3-diaminopyridine.

8. A material as claimed in claim 4 wherein the dyestuff is a condensation product of perylene-3,4,9,10-tetracarboxylic acid and 2,3-diaminopyrazine.

9. A material as claimed in claim 1 wherein the dyestuff is a compound of the formula

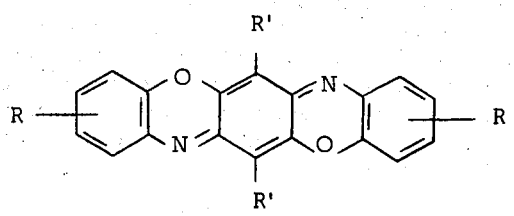

wherein

R is selected from the group consisting of a propionylamino group, a benzoylamino group, or a lower alkoxy group, and R' is a halogen atom.

10. A material as claimed in claim 1 wherein the dyestuff is a compound of the formula:

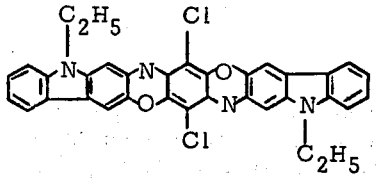

11. A material as claimed in claim 1, wherein the dyestuff is a compound of the formula:

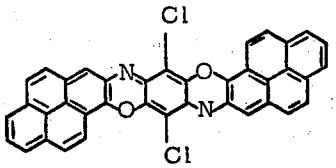

12. A material as claimed in claim 1 wherein the organic substance capable of transporting charges comprises a monomeric aromatic or heterocyclic compound.

13. A material as claimed in claim 12 wherein the charge-transporting substance comprises at least one dialkylamino-substituted or dialkoxy-substituted oxdiazole.

14. A material as claimed in claim 13 wherein the charge-transporting substance comprises 2,5-bis(4-diethylaminophenyl)oxdiazole-1,3,4.

15. A material as claimed in claim 12 wherein the charge-transporting substance comprises at least one dialkylamino-substituted or dialkoxy-substituted oxazole.

16. A material as claimed in claim 15 wherein the charge-transporting substance comprises 2-phenyl-4-(2-chlorophenyl)-5(4-diethylaminophenyl) oxazole.

17. A material as claimed in claim 1 wherein the charge-transporting substance comprises a polymeric aromatic or heterocyclic compound.

18. A material as claimed in claim 17 wherein the charge-transporting substance comprises a vinyl-aromatic polymer.

19. A material as claimed in claim 17 wherein the charge-transporting substance comprises poly-N-vinylcarbazole or a copolymer of N-vinylcarbazole having an N-vinylcarbazole content of at least 40 per cent by weight.

20. A material as claimed in claim 1 wherein the charge-transporting substance comprises a condensation product of formaldehyde and 3-bromopyrene.

21. A material as claimed in claim 1 wherein the charge-transporting substance comprises 2,4,7-trinitrofluoren-9-one.

22. A material as claimed in claim 1 which comprises a mixture comprising a charge-transporting substance and a dyestuff on the conductive support.

23. A material as claimed in claim 22 wherein the layer comprising the charge-transporting substance also includes a natural or synthetic resin binder.

24. A material as claimed in claim 1 which comprises a first layer including a dyestuff on the conductive support and a second layer including a charge-transporting substance on the first layer.

25. A material as claimed in claim 24 wherein the dyestuff layer has a thickness within the range of about 0.005 to 2 microns.

26. A material as claimed in claim 25 wherein the dyestuff layer has a thickness within the range of about 0.005 to 0.5 micron.

27. A material as claimed in claim 24 wherein the layer including the charge-transporting substance is transparent.

28. A material as claimed in claim 24 wherein the thickness of the layer including the charge-transporting substance is within the range of about 5 to 40 microns.

29. A material as claimed in claim 28 wherein the charge-transporting substance is monomeric and wherein the thickness of the layer is within the range of about 8 to 40 microns.

30. A material as claimed in claim 28 wherein the charge-transporting substance is polymeric and wherein the thickness of the layer is within the range of about 5 to 20 microns.

31. A material as claimed in claim 1 including an insulating intermediate layer between the conductive support and a layer containing the organic substance capable of transporting electrical charge and the dyestuff.

32. A material as claimed in claim 31 in which the intermediate layer comprises organic material.

33. A material as claimed in claim 32 wherein the organic intermediate layer comprises a polyamide or polyvinylphosphonic acid.

34. A material as claimed in claim 32 wherein the organic layer has a thickness of up to 5 microns.

35. A material as claimed in claim 31 which includes an intermediate layer comprising a thermally, anodically or chemically produced aluminum oxide intermediate layer.

36. A material as claimed in claim 35 wherein the thickness of the aluminum oxide layer is within the range of about $10^2$ to $10^4$A.

37. A process for the preparation of an electrophotographic recording material comprising a conductive support, a first layer on said support including a dyestuff of purple to violet color, having:

a. an X value in the range of from 0.13 to 0.52 and a Y value within the range of from 0.019 to 0.33 in the CIE system, b. an extended $\pi$-electron system of at least 20 $\pi$-electrons, and c. possessing a reflectance of not more than 50% throughout the spectral region of 420 to 750 nm when in the form of a single color-masking layer of about 0.1 g/m$^2$, and which has a high photosensitivity throughout the said spectral range, and a second layer including an organic photoconductive substance capable of transporting electrical charge selected from the group consisting of p- and n-conducting compounds on the first layer, which comprises forming said first layer by vacuum-vapor deposition of the dyestuff onto the support.

38. A process as claimed in claim 37 wherein the dyestuff is vapor-deposited at a pressure within the range of about $10^{-3}$ to $10^{-5}$ mm Hg.

39. A process as claimed in claim 37 wherein the dyestuff is vapor-deposited at a temperature within the range of about 250° to 400°C, the temperature of the conductive support being below about 50°C.

* * * * *